US007416230B2

(12) United States Patent
Konstantakis et al.

(10) Patent No.: US 7,416,230 B2
(45) Date of Patent: Aug. 26, 2008

(54) SAFETY LOCK FOR LEVER-TYPE DOOR HANDLES

(76) Inventors: George C. Konstantakis, 7969 S. Forest Meadows Dr., Franklin, WI (US) 53132; Georgia L. Konstantakis, 7969 S. Forest Meadows Dr., Franklin, WI (US) 53132

( * ) Notice: Subject to any disclaimer, the term of this patent is extended or adjusted under 35 U.S.C. 154(b) by 264 days.

(21) Appl. No.: 10/530,635

(22) PCT Filed: Oct. 6, 2003

(86) PCT No.: PCT/US03/31608

§ 371 (c)(1),
(2), (4) Date: Oct. 28, 2005

(87) PCT Pub. No.: WO2004/033827

PCT Pub. Date: Apr. 22, 2004

(65) Prior Publication Data

US 2006/0170226 A1 Aug. 3, 2006

Related U.S. Application Data

(60) Provisional application No. 60/431,335, filed on Dec. 5, 2002, provisional application No. 60/416,684, filed on Oct. 7, 2002.

(51) Int. Cl.
*E05C 19/18* (2006.01)
*E05B 3/00* (2006.01)

(52) U.S. Cl. ..... 292/288; 292/1; 292/336.3; 292/DIG. 65; 70/14

(58) Field of Classification Search ..... 292/1, 292/92, 288, 289, 297, 298, 336.3, DIG. 2, 292/DIG. 65; 70/14
See application file for complete search history.

(56) References Cited

U.S. PATENT DOCUMENTS

| | | | | |
|---|---|---|---|---|
| 2,463,195 | A | 3/1949 | Mungan | |
| 4,196,602 | A * | 4/1980 | Akselsen | 70/211 |
| 4,605,251 | A | 8/1986 | Finlay | |
| 4,715,200 | A | 12/1987 | Katsaros | |
| 4,798,069 | A * | 1/1989 | DeForrest, Sr. | 70/428 |
| 4,899,564 | A * | 2/1990 | Gilbert | 70/428 |
| 5,035,128 | A | 7/1991 | Ridgway | |
| 5,052,202 | A | 10/1991 | Murphy | |
| 5,718,133 | A | 2/1998 | Chen et al. | |
| 5,791,174 | A * | 8/1998 | Fitzgerald et al. | 70/212 |
| 6,301,941 | B1 | 10/2001 | Nicholsfigueiredo | |
| 6,360,568 | B1 | 3/2002 | Chen | |
| 6,929,292 | B1 * | 8/2005 | Galindo et al. | 292/288 |
| 7,048,315 | B2 * | 5/2006 | Wong | 292/297 |
| 2006/0076787 | A1 * | 4/2006 | Sundberg et al. | 292/336.3 |

FOREIGN PATENT DOCUMENTS

GB 2088463 * 6/1982

* cited by examiner

*Primary Examiner*—Carlos Lugo
(74) *Attorney, Agent, or Firm*—Boyle Fredrickson S.C.

(57) ABSTRACT

An add-on safety lock that blocks lever rotation by bracing the lever against a fulcrum point at the handle shaft and nearby door structure.

21 Claims, 4 Drawing Sheets

SAFETY LOCK FOR LEVER-TYPE DOOR HANDLES

CROSS-REFERENCE TO RELATED APPLICATIONS

This application is based on U.S. provisional applications 60/416,684 filed Oct. 7, 2002, and 60/431,335 filed Dec. 5, 2002, both hereby incorporated by reference.

BACKGROUND OF THE INVENTION

The present invention relates to mechanisms for securing doors from being opened by small children, and in particular, to a device suitable for doors with lever-type door handles.

Architectural doors may have a latch mechanism holding the door closed and operated by means of a doorknob. Particularly for interior doors, the latch mechanism may be without a lock, and therefore readily opened by anyone turning the doorknob.

Parents with small children who wish to secure a door, for example, a door leading to stairs or other hazards, may make use of an add-on "safety lock" that prevents the child from opening the door. A commonly available safety lock for standard doorknobs covers the doorknob with a loosely fitting shell which rotates freely around the doorknob. A child grasping the shell can turn only the shell and not the contained knob. An adult with greater hand strength may compress the shell against the doorknob so as to enable rotation of the doorknob through the shell. This type of safety lock differentiates between adults and children in part by hand strength and requires that the doorknob be rotationally symmetric.

In recent years, such symmetric doorknobs have given way to lever handles which can be easier for the infirm and handicapped to actuate. A safety lock using a rotating shell design does not work with such lever handle systems, which are not rotationally symmetric, and have a wide variety of lever sizes.

Nevertheless, it is often desired to secure doors having such lever handles from opening by small children, and in fact, lever handles may in some cases be easier for small children to open, to the extent that the child may be drawn to reach up and hang upon the lever.

SUMMARY OF THE INVENTION

The present invention provides a safety lock for lever-type door handles that blocks rotation of the handle by bracing the handle against both the handle shaft and at least one stationary point on the door structure, typically the door jam. In this way, the lever need not be fully shrouded and a wide variety of different door handles may be accommodated.

Specifically, the present invention provides a child safety lock for doors with lever handles of a type having a rotatable shaft extending from the door and a lever extending radially from the handle shaft. The child safety lock comprises a lever grip engaging a portion of the lever and a fulcrum element attached to the lever grip to be positioned proximate to the shaft as a fulcrum. At least one arm having a first end attached to the fulcrum element extends radially therefrom to a second end sized to interfit with a stationary door structure. As configured, a force of rotation of the lever in an unlocking direction may be conducted by the lever grip through the fulcrum element to the shaft, and through the arm to the stationary door structure.

Thus it is one object of the invention to provide an add-on safety lock for lever door handles.

The arm may be sized so that the second end interfits with a door jam adjacent to the door handle when the door is closed.

Thus it is another object of the invention to engage a structure commonly available near the handle.

The fulcrum element may be a collar surrounding the shaft.

Thus it is another object of the invention to provide a mechanism that is retained when locked and unlocked.

The collar may include at least a first and second collar portion separable for insertion of the shaft within the collar.

Thus it is another object of the invention to provide a collar that may conform closely to the shaft of the handle without creating problems installing it over the lever.

The collar may include at least one latch for releasably retaining the collar in a closed position around the shaft after the shaft is inserted into the collar.

It is thus an object of the invention to prevent accidental dislodgment of the collar from the shaft.

The collar may include space-filling elements allowing the inner opening of the collar to conform to shafts of different diameters.

It is thus another object of the invention to accommodate multiple handle designs with different-sized shaft or shafts that are not cylindrical.

The space filling elements may be spring fingers extending inward from an inner edge of the collar to flexibly press against the outer circumference of the shaft.

It is thus an object of the invention to provide an embodiment in which multiple spacer elements need not be provided, but which may conform and automatically adjust to the shaft size.

The arm may include a release allowing it to be displaced from interfitting with the stationary door structure for rotation of the lever.

It is thus another object of the invention to allow an adult operating the release to open the door without detaching the safety lock from the handle.

The arm may include a pivot operating about an axis substantially parallel to the axis of the shaft and the release may be a catch preventing pivoting of the arm except when the catch is released.

It is thus another object of the invention to provide a release mechanism that is simple and does not produce unwieldy extensions from the door.

The lever grip may be a collar surrounding the lever.

It is thus another object of the invention to provide a positive retention of the lever and a gripping of levers of arbitrary length in a single device.

The safety lock may include a second arm extending radially from the fulcrum to a second end sized to interfit with a stationary door structure.

It is thus another object of the invention to provide a lock that may block two directions of rotation of the lever handle.

The lever grip fulcrum element and arm may be polymer materials.

Thus it is another object of the invention to provide a device that is simple to manufacture but that reduces risk of damaging or marring the door when in direct contact with the door.

The release mechanism may be oriented on top of the safety lock when the safety lock is in place and locked on a door handle.

Thus it is another object of the invention to displace the release mechanism from the access by or sight of small children.

The arms may have feet portions that ride against the front surface of the door.

It is another object of the invention to provide a lock that rests stably on the door when attached to the door handle.

These particular objects and advantages may apply to only some embodiments falling within the claims, and thus do not define the scope of the invention.

DETAILED DESCRIPTION OF THE PREFERRED EMBODIMENT

Figure 1:
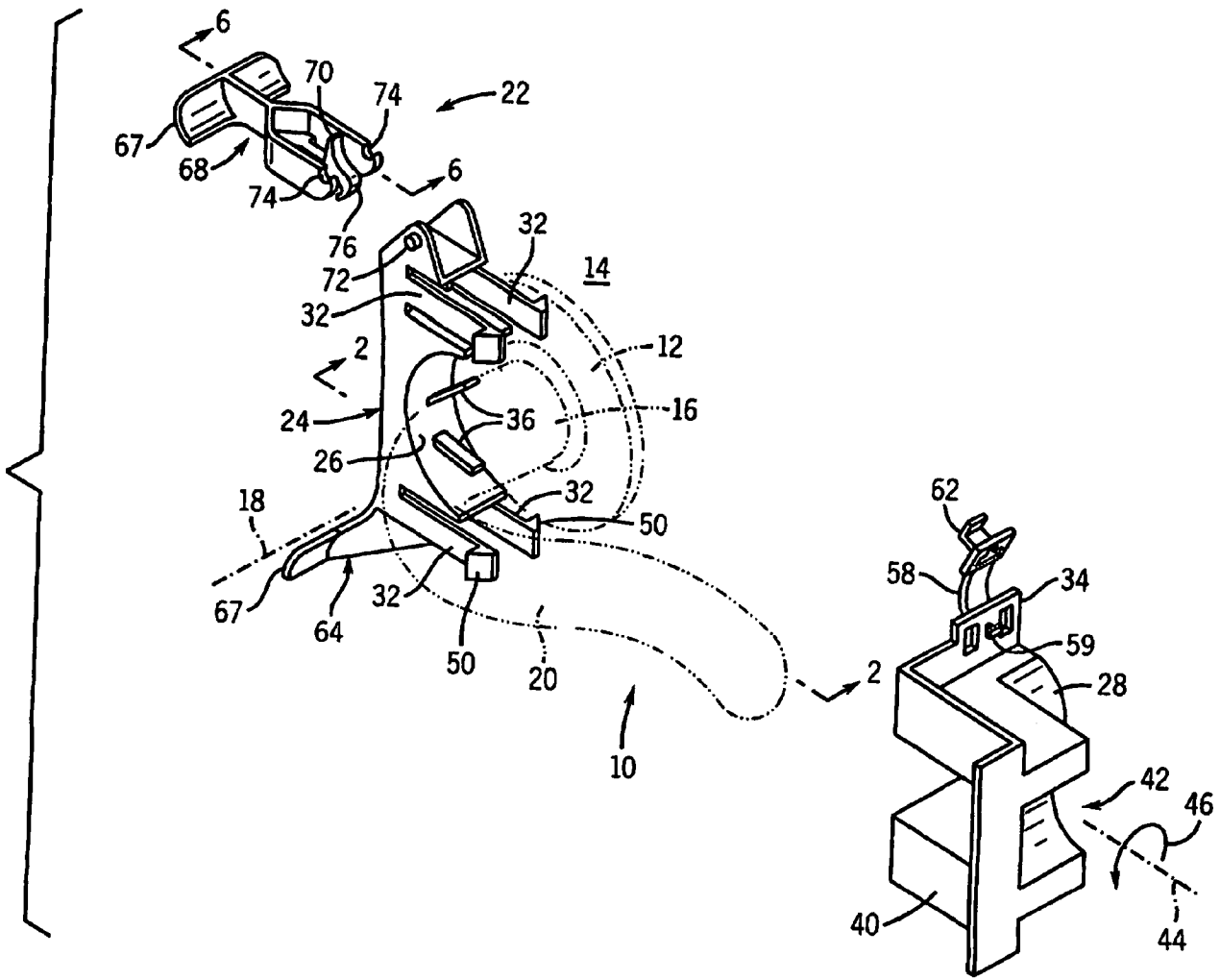
FIG. 1 is a an exploded perspective view of the three components of the safety lock of a preferred embodiment of the invention partially assembled around a lever door handle shown in phantom.

Referring now to FIG. 1, a lever-type door handle 10 includes an escutcheon plate 12 fitting against a front surface of the door 14. A shaft 16 may extend from the door 14 along a shaft axis 18 about which the shaft 16 may turn. A lever 20 extends radially from the exposed end of the shaft 16 to be grasped by the user to rotate the shaft 16 to operate a latch mechanism within the door (not shown) as is generally understood in the art.

Figure 2:
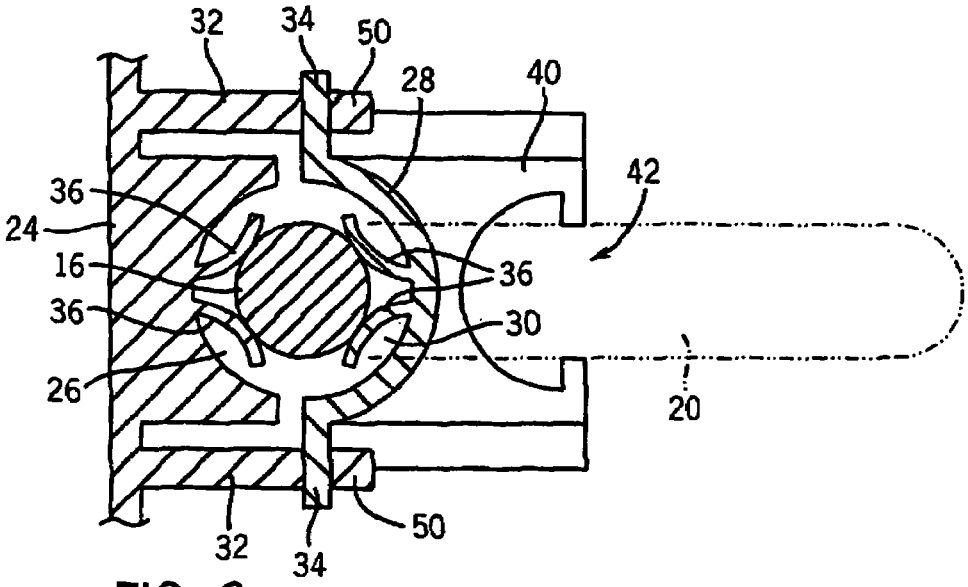
FIG. 2 is a fragmentary cross-sectional, front elevational view through the assembled invention along lines 2-2 of FIG. 1 showing attachment of two collar portions about the shaft of the handle and the compression of space filling elements therein.

Referring also to FIG. 2, a safety lock 22 per the present invention provides a first collar portion 24 having a hemicylindrical opening 26 for fitting about a left side of the shaft 16 as depicted and a second collar portion 28 having a hemicylindrical opening 30 for fitting about a right side of the shaft 16, together providing a cylindrical bore through which shaft 16 may pass.

As seen in both FIGS. 1 and 2, space filling elements 36 may extend inward from the inner surfaces of the hemicylindrical cavities of first collar portion 24 and second collar portion 28; the space filling elements 36 being flexible fingers diverging from a line of diameter of the formed cylindrical bore in a V-form opening toward the center of the cylindrical bore. The fingers may flex outward to fill the space between the outer circumference of the shaft 16 and the inner surface of the formed cylindrical bore preventing looseness in the interfitting of the first collar portion 24 and second collar portion 28 about the shaft 16 such as would cause a rattling or inadvertent pivoting thereabout.

Referring now to FIGS. 1, 3, 4*a*, and 4*b*, the second collar portion 28 may be held to first collar portion 24 by barbed fingers 32 extending horizontally from the first collar portion 24 and passing through retaining slots 48 on collar tabs 34 on second collar portion 28. The barbed fingers 32 may flex inward to allow their outwardly extending barbs 50 to pass through the slots 48 in the collar tabs 34 and engage the outer surface thereof. Further engaging motion of the barbed fingers 32 and collar tabs 34 is stopped by molded stop 52 projecting upward from first collar portion 24 between the barbed fingers 32.

Outward flexure of the barbed fingers 32 is sufficient to hold collar tabs 34 of second collar portion 28 in place, however, additional security is provided by means of stop plates 56 attached by living hinges 58 to an outer edge of the collar tabs 34. The stop plates 56 fit between tips of the barbed fingers 32 after they have passed through the collar tabs 34 preventing them from flexing inward such as might disengage their barbs 50 from the surface of the collar tabs. A T-retainer 59 extends outward from the collar tabs 34 to be received in a dual width slot 60 in the stop plate 56. One portion of the dual width slot 60 allows free passage of the head of the T-retainer 59 through the dual width slot 60 while the other portion of the dual width slot 60 is sufficiently narrow to block passage of the head of the T-retainer 59 thereby capturing the stop plate 56 beneath the head of the T-retainer 59. A handle 62 projects outward from the stop plate 56 to allow engagement and disengagement of the stop plate 56 from the T-retainer 59.

As described, the first collar portion 24 and second collar portion 28 may be thus easily assembled and disassembled about the shaft 16 without needing to thread the collar so formed over lever 20.

Figure 3:
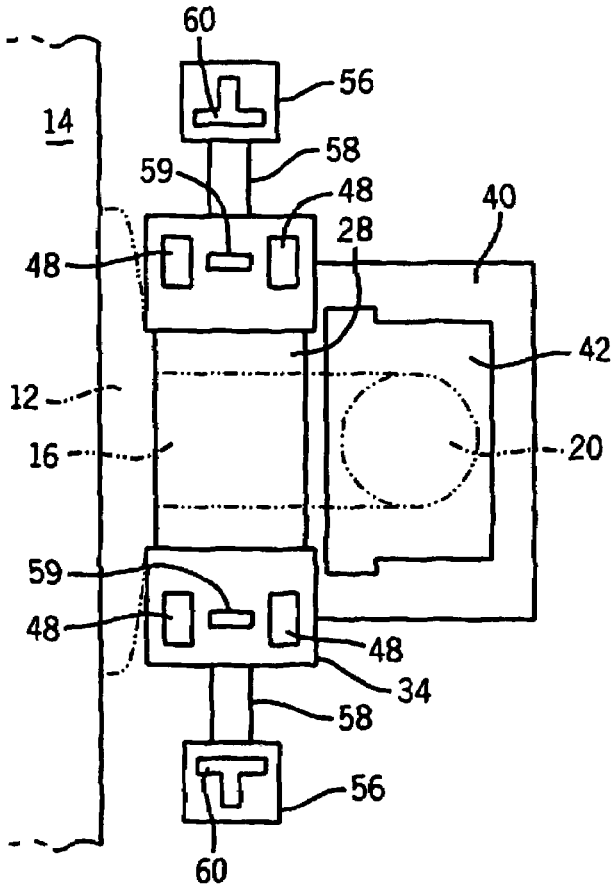
FIG. 3 is a right side, elevational view of a lever grip attached to one of the collar portions for receiving the lever in a cage to retain the lever, the figure further showing the offset of the cage with respect to the collar.
Figure 4A:
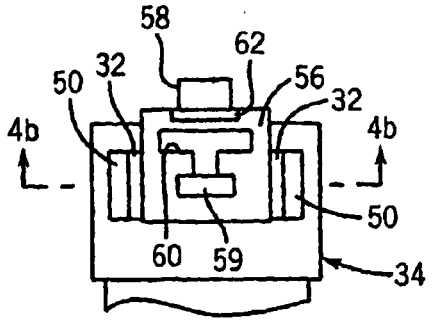
FIG. 4*a* is a fragmentary right side, elevational view of a collar tab for holding the collar portions together.
Figure 4B:
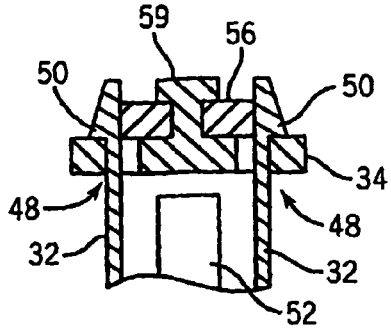
FIG. 4*b* is a cross-sectional view through the collar tab along lines 4*b*-4*b* showing a stop blocking the disengagement of barbed fingers.

Referring to FIGS. 1,2, and 3, the second collar portion 28 includes a cage 40 defining an opening 42 through which the lever 20 may pass to be surrounded on all sides. This opening 42 may also have space filling elements (not shown) allowing the cage 40 to conform to handle levers 20 of different widths and thicknesses or a single opening size may be used, as shown, allowing some limited and acceptable handle rotation.

As shown in FIG. 3, generally the opening 42 of the cage 40 is offset outward from the door 14 with respect to the second collar portion 28 around the shaft 16. This offset is reversed for the lever on the opposite side of the door and yet both lever directions may be accommodated by a 180-degree rotation 46 of the second collar portion 28 about a radial axis 44, prior to its engagement with first collar portion 24 as shown in FIG. 1. The barbed fingers 32 of the first collar portion 24 and the slots 48 of the collar tabs 34 of the second collar portion 28 are symmetric so as to allow this rotation 46 while still permitting the connection between the barbed fingers 32 and the slots 48. In this way, lever handles on either side of the door 14 may be secured with the present device.

Figure 5:
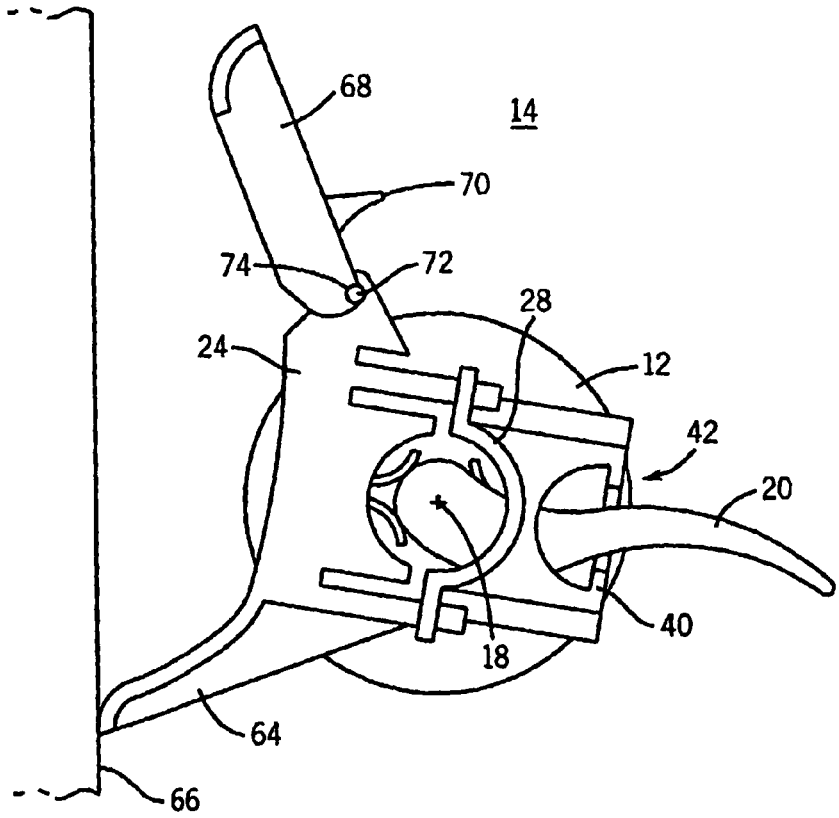
FIG. 5 is a front elevational view of the assembled components of FIG. 1 showing blocking of the handle of a door against clockwise rotation by a first arm abutting a door jam.

Referring now to FIGS. 1 and 5, attached to the first collar portion 24 are an upper arm 68 and lower arm 64, each extending radially from the shaft 16 at approximately equal angular spacing about axis 18 to each other as to the lever 20. The arm 64 is sized so that downward motion (clockwise) of the lever 20, acting through the cage 40 against a fulcrum provided by the first and/or second collar portions 24 and 28, brings the distal end of arm 64 upward into abutment with the vertical jam wall 66 being part of the casing of door structure. Conversely, upward motion (counterclockwise) of the lever 20 acting through the cage 40 against a fulcrum provided by the first and/or second collar portions 24 and 28 brings the distal end of arm 68 downward against the vertical jam wall 66.

The arms 64 and 68 are sized so that the free rotation of the lever 20 is insufficient to cause the lock mechanism with the door 14 to withdraw the bolt (not shown) holding the door shut. The arms 64 and 68 include at their distal ends, spreaders 67 extending axially that provide an edge that may ride along the face of the door 14 to stabilize the safety lock and ensure engagement with the jam.

It will be understood that arms 64 and 68 together prevent the opening of the door 14 by moving the lever 20 up or down. This is the highest level of security. The arm 64 alone may, however, prevent the opening of the closed door 14 where the expectation is that the child will only be able to pull downward on the lever 20. In this case, a parent or guardian may simply raise the lever 20 to open the door 14.

Figure 6:
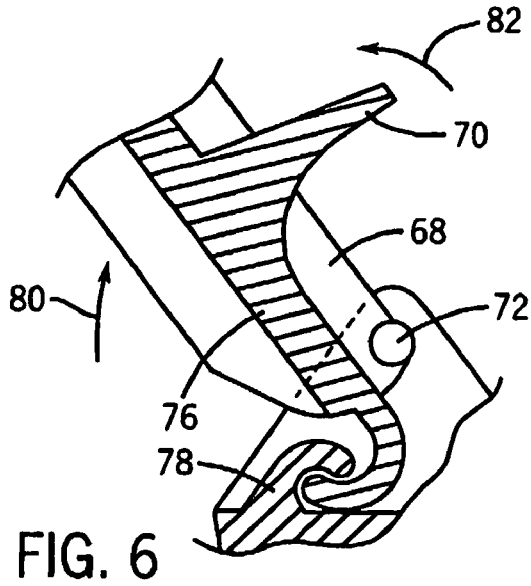
FIG. 6 is a cross sectional view along lines 6-6 of FIG. 1 showing a release allowing a folding back of a second arm of FIG. 7.
Figure 7:
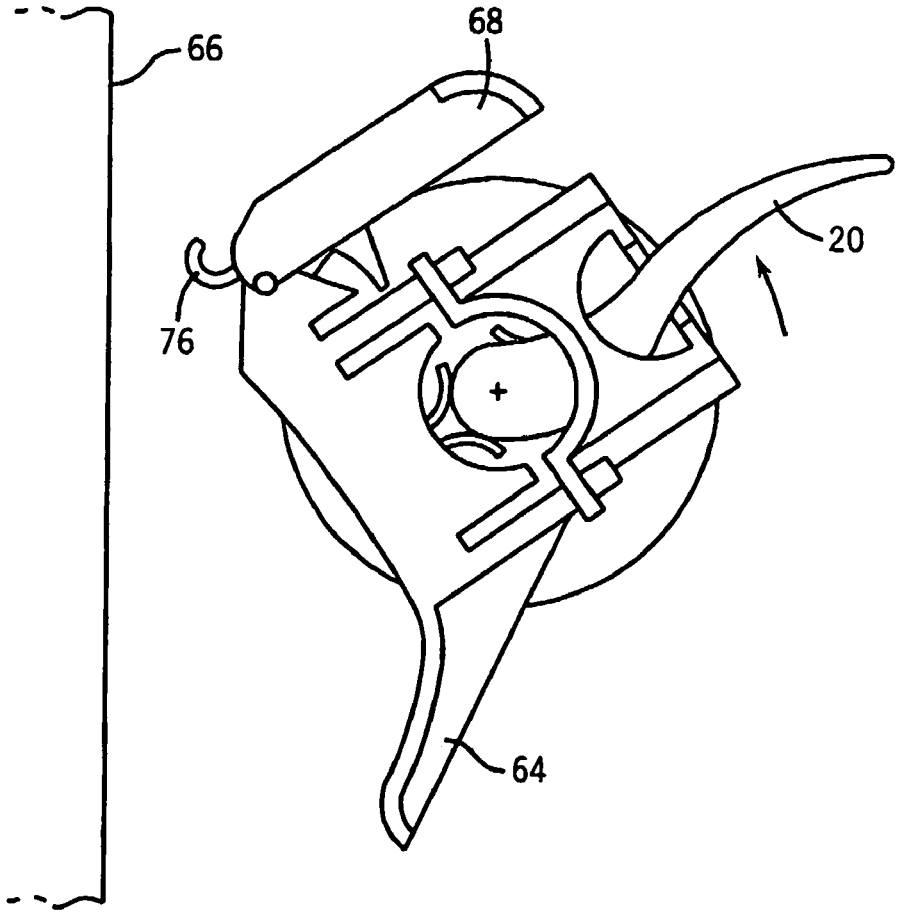
FIG. 7 is a fragmentary view similar to that of FIG. 5 showing a folding back of a second arm allowing lifting of the lever.

An opening of the door 14 or this lower level of security may be obtained by a retraction of lever arm 68 through the use of a release lever 70. Referring to FIGS. 1, 7, and 6, this retraction of arm 68 is accomplished by attaching arm 68 to first collar portion 24 by means of pivot pins 72 extending axially from the first collar portion and fitting within corresponding pivot holes 74 in the proximal end of arm 68 so that arm 68 may swing about an axis generally parallel to axis 18 while remaining adjacent to the plane of the door 14. Unintended retraction of the arm 68 when the lever 20 is to be locked against upward motion is provided by means of a flexible hook 76 extending within the arm 68 from its distal to proximal end. The hook engaging a catch surface 78 attached to the first collar portion 24 between the pivot pins 72 to which the arm 68 is attached. The hook 76, when engaged, resists upward motion 80 of the arm 68 until the hook 76 is disengaged from the catch surface 78 by a backward pressing of the release lever 70 as indicated by arrow 82.

The above-described design is amenable to injection molding where each of the arm 68, the first collar portion 24 and the second collar portion 28 are separately molded as integral parts and assembled, the first collar portion 24 and second collar portion 28 assembled together via the barbed fingers 32 as described above, and the arm 68 assembled to the first collar portion 24 by snapping it onto the pivot pins 72. Fabricating the safety lock of the present invention from plastic material such as polypropylene provides for good resilience and low risk of marring the door 14 and the flexibility required of the space filling elements 36, living hinge 58, and flexible latch hook 76.

While what has been described is a preferred embodiment, it will be recognized that the principle described herein may be applicable to safety locks which engage stationary door structure not limited to the casing surrounding the door but including, for example, the slot between the door and the casing as gripped by a pin or blade extending into the slot from the distal ends of one or both of arms 64 and 68.

From the description herein, variations of this invention will be understood to include those which engage portions of the surface of the door 14 with frictional elements and semi-permanent attachments to the front surface of the door. Although a collar that fully surrounds the shaft 16 is described, it will be understood that during normal use only portions of the collar contact the shaft 16, and therefore a collar which does not fully enclose shaft 16 may be used.

It is specifically intended that the present invention not be limited to the embodiments and illustrations contained herein, but include modified forms of those embodiments including portions of the embodiments and combinations of elements of different embodiments as come within the scope of the following claims.

We claim:

1. A child safety lock for door latch mechanisms having a rotatable shaft extending from a door and a lever extending radially from the rotatable shaft, the child safety lock comprising:

a lever grip element configured to engage a portion of the lever to limit free motion of the lever as would be necessary to open the door latch mechanism;

a fulcrum element attached to the lever grip element so as to be positioned proximate to the shaft as a fulcrum about the shaft;

a connecting element having a first end attached to the fulcrum element and extending radially therefrom to a second end sized to interfit with a stationary door structure;

whereby the child safety lock conducts a force of rotation of the lever in a direction toward the connecting element to the stationary door structure thereby preventing rotation of the lever in the direction toward the connecting element.

2. The child safety lock of claim 1 wherein the connecting element is sized so that the second end interfits against a door jam adjacent to the door handle when the door is closed.

3. The child safety lock of claim 1 wherein the fulcrum element is a collar for surrounding the shaft.

4. The child safety lock of claim 3 wherein the collar includes at least a first and second collar portion openable for insertion of the shaft within the collar.

5. The child safety lock of claim 4 wherein the collar includes at least one latch for releasably retaining the collar closed about the shaft after the collar has been positioned about the shaft.

6. The child safety lock of claim 3 wherein the collar includes space filling elements allowing an opening of the collar to conform to different diameter shafts.

7. The child safety lock of claim 6 wherein the space filling elements are spring fingers extending inward from an inner edge of the collar to flexibly press against an outer circumference of the shaft.

8. The child safety lock of claim 1 further comprising another connecting element that includes a release allowing it to be displaced from interfitting with a stationary door structure for rotation of the lever in a direction toward the another connecting element.

9. The child safety lock of claim 8 wherein an operator of the release extends from an upper side of the safety lock when the safety lock is positioned about the rotatable shaft.

10. The child safety lock of claim 8 wherein the another connecting element is an arm and includes a pivot and the release is a catch preventing pivoting of the arm except when the catch is released.

11. The child safety lock of claim 1 wherein the lever grip element is a collar surrounding the lever.

12. The child safety lock of claim 1 wherein the lever grip element is asymmetric about a plane perpendicular to an axis of the shaft and wherein the lever grip element may be rotated about a radial axis for use with lever handles on either side of a door.

13. The child safety lock of claim 8 wherein the connecting element and another connecting element prevent rotation of the lever in clockwise and counterclockwise directions when both are interfitted with the stationary door structure.

14. The child safety lock of claim 13 wherein the another connecting element includes a release for allowing the another connecting element to be displaced from interfitting with a stationary door structure to allow rotation of a lever of a door only in an upward direction.

15. The child safety lock of claim 1 wherein the lever grip element, fulcrum element, and connecting element are polymer materials.

16. The child safety lock of claim 1 wherein the connecting element has feet portions that ride against a front surface of a door equipped with the child safety lock.

17. A child safety lock for door latch mechanisms which have a lever that extends radially from a rotatable shaft which extends from a door, the child safety lock comprising:

an arm element;

a release lever;

a collar assembly attachable about the rotatable shaft of the door latch mechanism and communicating with the arm element through the release lever and with stationary door structure so that a force of rotation of the lever in an unlocking direction is conducted from the collar assembly to the stationary door structure via the arm element when the release lever is in an engaged state and so that the arm element moves with the lever in an unlocking direction when the release lever is in a disengaged state.

18. The child safety lock of claim 17 wherein the collar assembly includes space filling elements allowing an opening of the collar to conform to shafts of different diameter.

19. A lock assembly selectively engageable with a door assembly for interfering with the operation of a door latch having a lever handle, the lock assembly comprising:

a first portion for engaging the lever handle;

a second portion for removably engaging the first portion such that the first portion and the second portion are secured to the door latch when the first portion and the second portion are engaged with one another; and an arm pivotably connected to the second portion, the arm being movable between a first position wherein the arm prevents operation of the lever handle and a second position wherein the first portion and the second portion rotate with the lever handle during operation of the door latch.

20. The lock assembly of claim 19 further comprising another arm extending from the second portion, the arm and another arm fixing a position of the lever handle relative to the door only when the arm is in the first position.

21. A child safety lock for door latch mechanisms having a rotatable shaft extending from a door and a lever extending radially from the rotatable shaft and movable in at least one unlocking direction, the child safety lock comprising:

a lever grip element configured to engage a portion of the lever to limit free motion of the lever as would be necessary to open the door latch mechanism;

a fulcrum element attached to the lever grip element so as to be positioned proximate to the shaft as a fulcrum about the shaft;

at least one connecting element having a first end attached to the fulcrum element and extending radially therefrom to a second end sized to interfit with a stationary door structure, the number of connecting elements used to interfit with the stationary door structure being equivalent to the number of unlocking directions of the lever; and whereby the child safety lock conducts a force of rotation of the lever in an unlocking direction to the stationary door structure thereby preventing rotation of the lever in at least one direction.

* * * * *